US005077869A

United States Patent [19]

Haase

[11] Patent Number: 5,077,869

[45] Date of Patent: Jan. 7, 1992

[54] MONEY AND CREDIT CARD CARRIER

[76] Inventor: L. Bardes Haase, 140 Montgomery Cir., New Rochelle, N.Y. 10804

[21] Appl. No.: 685,865

[22] Filed: Apr. 16, 1991

[51] Int. Cl.[5] ..... A44B 21/00

[52] U.S. Cl. ..... 24/336; 24/3 L; 24/335

[58] Field of Search ..... 24/336, 3 R, 3 F, 3 J, 24/3 L, 335, 482, 530, 531, 545, 546, 547, 563

[56] References Cited

U.S. PATENT DOCUMENTS

| | | | |
|---|---|---|---|
| 1,899,753 | 2/1933 | Felsenthal | 24/336 X |
| 2,358,262 | 9/1944 | Suess | 24/36 X |
| 3,555,623 | 1/1971 | Cocchiaraley | 24/336 X |
| 3,802,032 | 4/1974 | Weed | 24/336 X |
| 3,861,002 | 1/1975 | Gordon | 24/336 |

FOREIGN PATENT DOCUMENTS

| | | | |
|---|---|---|---|
| 102503 | 4/1953 | France | 24/336 |

*Primary Examiner*—Laurie K. Cranmer
*Attorney, Agent, or Firm*—John W. Cornell

[57] ABSTRACT

A new and improved credit card/money clip device is provided by a base member having first and second generally opposed major surfaces. A clip for holding folded currency is defined on one side of the base member and credit card receiving area is defined by resilient elastic holding straps adjacent the second major surface. The credit card/money clip device provides a compact, low profile device and method for carrying money and cards in an organized and supported manner in a pants pocket or the like.

17 Claims, 2 Drawing Sheets

Fig.9
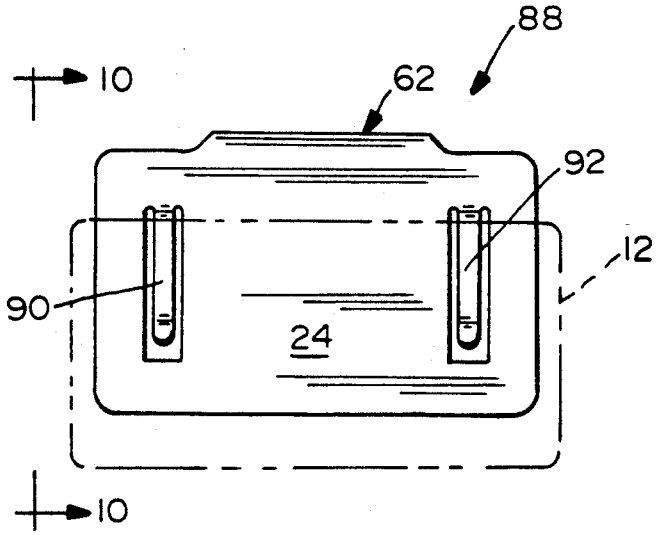
Fig.10
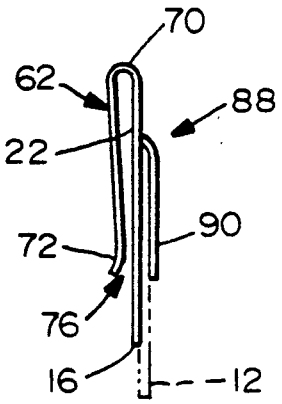
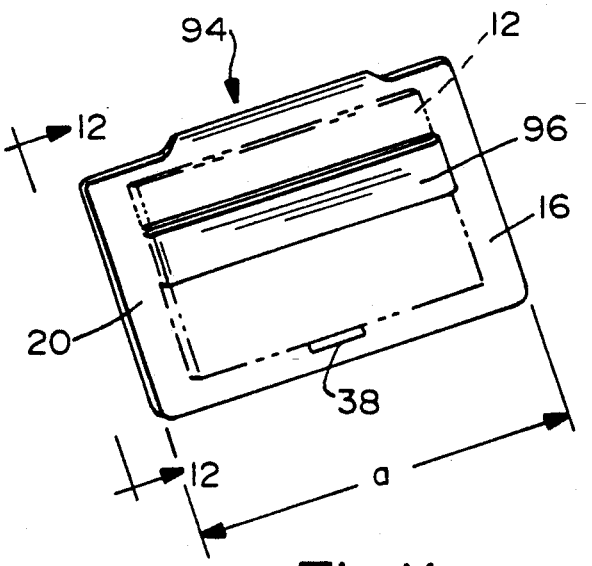
Fig.11
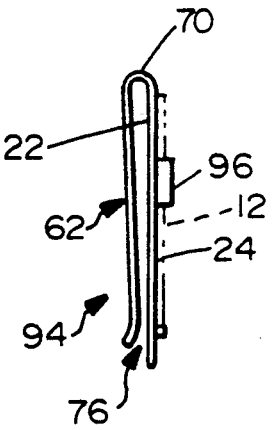
Fig.12

MONEY AND CREDIT CARD CARRIER

BACKGROUND OF THE INVENTION

The present invention generally relates to money clips for carrying money close to the body in a pants pocket, a shirt pocket or the like. More particularly, it relates to a new and improved credit card/money clip device for holding folding currency and one or more credit-type cards, automated teller machine cards, or identification cards together in a convenient, easy to use, pocket-sized carrier arrangement.

Money clips adapted to clampingly receive folded currency and designed to be carried in a pants pocket are well known. In the area of men's gifts and accessories, money clips fashioned from a single piece of bent or formed metal stock have been available for some time. Relatively expensive versions in plated or solid precious metals, such as silver and gold are well known.

In today's society, comfortable, casual attire has become the normal dress for shopping or entertainment inside as well as outside of the home. Earlier dress code requirements for men to wear a jacket and tie and for women to wear a skirt or dress have been relaxed or altogether abandoned. It is not unusual for men and women to do their errands, shopping and other weekend activities in casual jeans, sportswear and even sweatsuits.

Concurrent changes in the money and banking industry including the widespread introduction and use of automated teller machines and various consumer credit cards have created corresponding changes in the way people organize, handle and carry their money. For example, the need to carry a checkbook around with you is no longer as great as it once was, because you can pay for goods with cash obtained from a cash machine or with a credit card. People frequently may not want to carry a jacket for holding a wallet or checkbook anymore. Women frequently do not need or want to carry a purse around with them. A purse or a bulging wallet are usually clearly visible and therefore can be an easy target for a pick-pocket or other thief. Moreover, it is now common to carry only a small amount of money and to carry secure means for acquiring more money on the go. In this manner, if a person is held up or robbed, the credit cards and money cards are provided with a secure password or they can be canceled quickly by phone. As a result, the thief only gets the small amount of cash being carried.

Money clips are a convenient way to carry folded dollar bills in an organized, space-saving manner. However, it would be desirable if one or more credit-type cards and/or driver's license or other I.D.'s could also be carried in a pants pocket together with dollar bills in an organized, low profile or non-bulging manner capable of protecting the cards from becoming bent, scratched or broken while being carried Accordingly, it is an object of the present invention to provide a new and improved credit card/money clip device for conveniently carrying a number of credit card sized cards and folding currency in a convenient, easy to carry manner.

It is another object of the present invention to provide a credit card/money clip device having card holding features defined thereon for managing a stack of one or more cards in a protected, supported manner when carried in a pants pocket, shirt pocket or the like.

SUMMARY OF THE INVENTION

In accordance with these and other objects, the present invention provides a new and improved credit card/money clip device comprising a base member having first and second generally opposed major surfaces. A clip means is defined on one side of the base member for holding folded currency against the first major surface. The clip means may be a separate clip member adhered or affixed to the base member, but preferably the clip means comprises an integral unitary spring arm member providing the necessary clipping or holding characteristics.

The new and improved credit card/money clip device of the invention further includes a resilient holding means on an opposed side of the base member defining a credit card receiving area between the holding means and the second major surface. The resilient holding means preferably includes a resilient band means which may either be stamped and formed from the base material of the base member or the holding means may be any resilient elastic tape or strip attached or affixed to the base member and positioned to hold credit cards in a resilient biassed manner generally in face to face contact with each other and against the second major surface of the base member. Preferably, the clip means and the holding means are defined in relation to the base member of the device so that folded currency and at least one credit-type card may be releasably retained on the base member generally within a common peripheral outline defined by the base member and the credit type card combined. In other words, the credit cards and the folded currency are retained against the base member in a vertically aligned orientation wherein the base member is sandwiched between the currency on one side and the cards on the other. In a preferred embodiment, the base member may include projecting stop abutment portions which serve to positively locate or position a credit card or a wad of folded currency in a proper position against the base member for supported carrying in the pocket of the user.

In accordance with the present invention, the new and improved credit card/money clip device of this invention may be made from metal or molded or formed from a rubber or plastic material and may comprise an integral device or a unitary, i.e., a one-piece device. Preferably, the base member and the clip means of the device comprise a unitary metallic stamping. In accordance with this preferred embodiment, the stamping may be made from a sheet metal stock selected from brass, bronze, aluminum, chrome, tin, steel, stainless steel, pewter, silver or other sheet metal stocks as well as gold or silver plated versions of any of the foregoing sheet metal stocks.

In accordance with the preferred embodiment herein, the holding means for holding one or more credit type cards including credit cards, automatic teller machine cards or driver's licenses or other identification cards and the like against the second surface of the base member comprises a resilient elastic banding means. Preferably, the holding means is defined by a T-shaped strap formation of resilient fabric straps which are adapted to engage edge portions of a card to hold it in an oriented and retained position against the second surface of the carrier device The degree of resiliency in the banding means may vary and depending on the overall visual impact the device is to achieve, the resilient banding straps may be made, for example, of leather, rubber, lycra or other elastic or elastomeric material which may be readily obtained from commercial sources. The means for affixing the resilient bands to the base member may also vary in accordance with this invention. The straps may be affixed to the base, for example, by crimping, by the use of adhesives or any other suitable means.

In accordance with this invention, the base has a configuration for supporting the individual credit cards to prevent them from being bent and damaged or broken when placed in a pocket in use.

Other objects and advantages will become apparent from the following Detailed Description of the Invention, taken in conjunction with the Drawings in which:

BRIEF DESCRIPTION OF THE DRAWINGS

FIG. 9 is an elevated front view of another alternate embodiment of a credit card/money clip carrier including money clip means and credit card clip holding means;

FIG. 10 is an elevated side view of the alternate embodiment shown in FIG. 9 taken along view lines 10—10 in FIG. 9;

FIG. 11 is a perspective view of still another alternate embodiment of the present invention; and FIG. 12 is an elevated side view of the alternate embodiment taken along view lines 12—12 in FIG. 11.

DETAILED DESCRIPTION OF THE PREFERRED EMBODIMENTS

Figure 1:
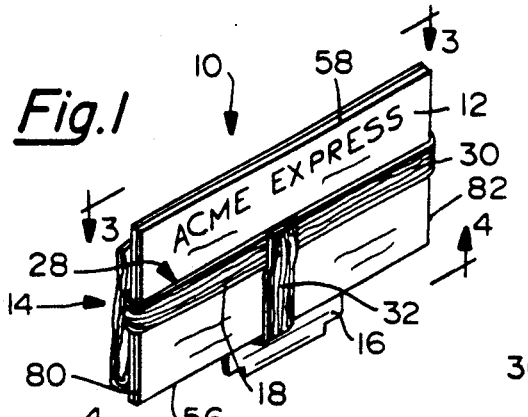
FIG. 1 is a perspective view of the new and improved credit card/money clip device of the present invention shown in use having folded currency secured to one side thereof and a credit card secured to the opposed side thereof.
Figure 3:
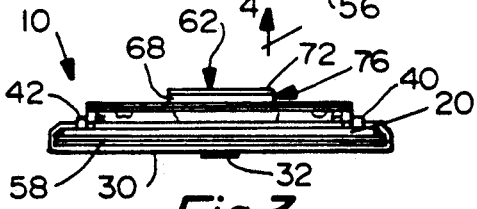
FIG. 3 is a top plan view of the new and improved credit card/money clip device of the present invention taken along view lines 3—3 in FIG. 1.
Figure 5:
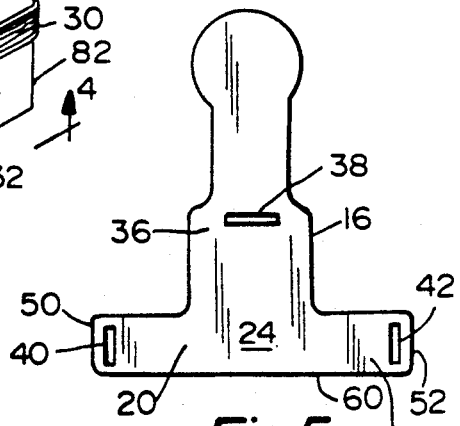
FIG. 5 is a preferred unitary metal stamping for forming the base member and clip means in the new and improved credit card/money clip device of the present invention.
Figure 4:
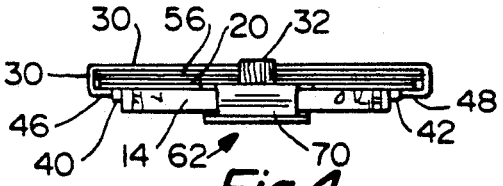
FIG. 4 is a bottom plan view of the new and improved credit card/money clip device of the present invention taken along view lines 4—4 in FIG. 1.
Figure 2:
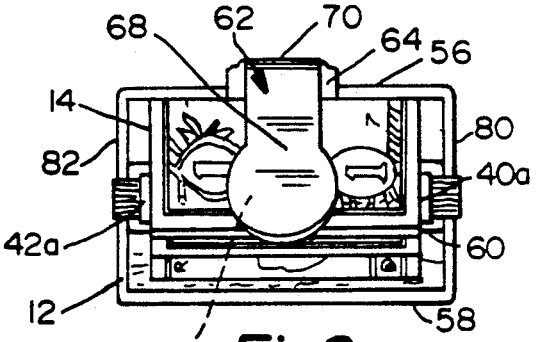
FIG. 2 is an elevated view of the new and improved credit card/money clip device of the present invention as shown in FIG. 1 and viewed from the rear.

Referring now to FIGS. 1-6, the preferred embodiment of the new and improved credit card/money clip carrier device, generally referred to by reference numeral 10, is shown. FIGS. 1-4 illustrate device 10 in use with at least one credit-type card 12 secured against one side and a wad of folded currency 14 secured against the other side. In accordance with this invention, device 10 provides a small, compact, low profile device and method for carrying money and cards in an organized and supported manner in a pants pocket or the like.

More particularly, in the preferred embodiment depicted in FIGS. 1-6, credit card/money clip device 10 includes a base member 16 and card holding means in the form of a resilient elastic t-strap member 18. Base member 16 includes a planar support portion 20 including first and second generally opposed major surfaces 22 and 24, respectively. A credit card receiving area 26 generally having a thin rectangular slot shaped opening 28 and configuration is effectively defined between the intersecting bands or straps 30 and 32 forming the t-strap member 18 and the second major surface 24 of planar support portion 20 from which the bands or straps 30 and 32 are spaced.

In the preferred embodiment shown in device 10, the planar support portion 20 of the base member 16 has side portions cut away to define a generally T-shaped configuration, to save on material costs. Although a T-shape is presently preferred, a complete rectangular or any other shape may generally be used as the configuration of the support portion 20 provided that it properly supports a credit card inserted into slot opening 28 and credit card receiving area 26 to prevent bending or breakage of the card in use, for example, when placed in a front pants pocket. The preferred T-shape of the base member 16 allows an end of the cards to flex slightly to conform them to the leg of the user, if necessary for increased comfort. Support portion 20 has an elongate upper arm structure 34 generally defining a length dimension, a, and a shorter segment 32 extending generally perpendicularly from one side of the upper arm structure 30 at about the midpoint of the length dimension, a. A width dimension, b, including shorter segment 32 and part of upper arm structure 30 as shown effectively defines a width dimension for the planar support portion 20.

Figure 6:
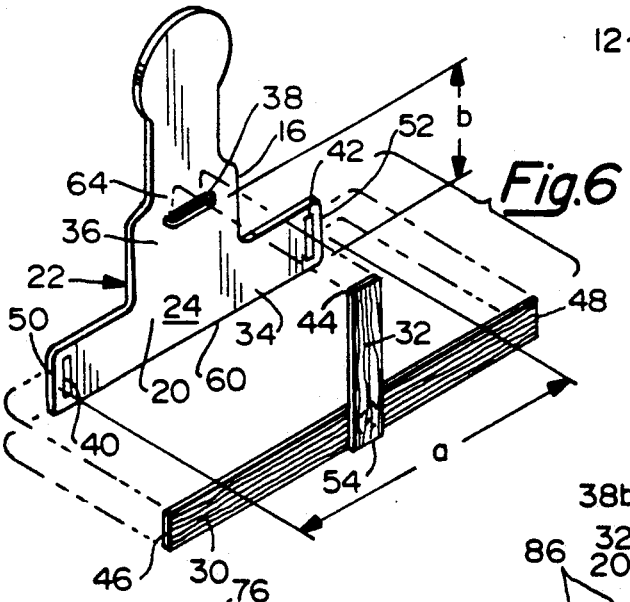
FIG. 6 is an exploded perspective view of the new and improved credit card/money clip device of the present invention illustrating one method for assembling same.
Figure 7:
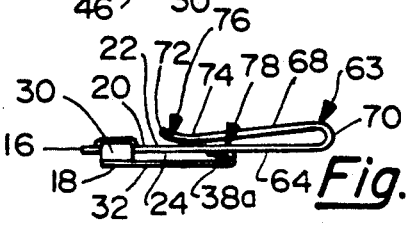
FIG. 7 is a side elevation view of the preferred device of the invention taken along view lines 7—7 in FIG. 6.

Referring now to FIGS. 2, 3 and 6-7, device 10 further includes a plurality of crushable crimp strip members 38, 40 and 42 for securing the free ends 44, 46 and 48, of T-strap forming bands 32 and 30 respectively, to the support portion 20 of base member 16 As is best shown in FIGS. 6-7, crimp strip member 38 on shorter segment 36 is formed up out of the planar support 20 so that it projects upwardly from the second major surface 24. Crimp strip members 40 and 42 are disposed adjacent the opposed free ends of upper arm structure 34 and are oppositely punched from the planar support 20 so that they each project upwardly from the first major surface 22. The elastic band members 30 and 32 are secured to the base member by inserting their respective free ends 44 and 46, 48 into the gaps of the crushable crimp members 38, 40 and 42 and the crimp strip members are crushed or compressed toward the planar support portion to grippingly engage the bands 30 and 32. The end 54 of shorter band 32 opposite free end 44 is affixed to an approximate midpoint of long band 30 by sewing, as shown, or by any other suitable affixing means including gluing, bonding, riveting, stapling, or a cooperating fastener such as a snap fastener may also be used.

As shown in FIGS. 2-4 and 6-7, even their fully crushed, strap engaging positions, the crimp strip sections 38, 40, 42 are almost flush with respect to the first or second major surfaces 22 and 24. Accordingly, inserted cards are permitted to float between the strap ends 44, 46 and 48, within defined limits with respect to the base member 16. More particularly, strap end 44 held in crimp strip 38 forms a forward stop **38*a* positioned to engage a leading edge 56 on an inserted credit card 12 to control the depth of insertion of the card within the card receiving area 26. The positioning of stop 38***a* in turn controls amount of overhang for the opposed edge 58 of credit card !2 from the edge 60 of upper arm structure 34. The resilient property of strap 32 will permit a minor amount of float in this insertion direction.

Similarly, the ends 46 and 48 of long band 30 secured by crimp strips 40 and 42 in their crushed condition define lateral stops or guides 40*a* and 42*a* which facilitate the centering of the cards with respect to the second major surface of planar support portion 20.

In the preferred embodiment of this invention as depicted in FIGS. 1–7, device 10 includes an integral unitary clip means 62 comprising a generally U-shaped spring member 63 defined by a first leg 64 extending from an end 66 of shorter segment 36, a second leg 68 interconnected to the first leg 64 by a curving bight portion 70. Second leg 68 has a free end 72 opposite bight portion 70 which is preferably coined or formed as indicated at 74 to define a flared entry 76 to a bill-receiving gap 78 for the clip section 62 to aid insertion of folded currency into the clip. As shown in FIG. 7, bight portion 70 includes an angle greater than 180° so that second leg 68 is disposed at angled orientation with respect to first leg 64 and the first major surface 22 so that the free end 72 is biased toward the first major surface 22.

As shown in FIGS. 1–4 and 6–7, the free ends 46 and 48 of longer strap 30 urges around the free ends 50 and 52 of the upper arm structure 34 to define a slot length dimension, c, to guide and position opposed side edges 80 and 82 of one or more cards inserted therein. The bands 30 and 32 are resiliently expandable to hold and maintain from one up to a reasonable number of cards arranged in stacked verticle relation in a centered face to face contact with second major surface 24 in parallel relation therewith.

In accordance with this invention, the base member 16 and the clip means 62 are preferably stamped and formed from a blank of sheet metal stock in accordance with methods well known to those skilled in the metal working arts. The gauge or thickness of the metal sheet stock may vary widely depending on the metal between 0.025 inch to about 0.300 inch, or more or less. The metal for forming the base member can be selected from any suitable metal having physical properties suitable for stamping and forming operations and which possesses the necessary resiliency in the formed state useful for clip means 62 and crimp sections 38, 40 and 42. Accordingly, the metal may be selected from aluminum, brass, bronze, phosphor bronze, chrome, copper, pewter, tin, steel, stainless steel, gold, silver, platinum and various alloys and precious metal plated versions of these metallic sheets. Alternatively, the base clip and holding members may be molded or die cast from metal, plastic or rubber materials. The T-strap section 18 including resilient elastic banding means 30 and 32 are preferably formed of elastic fabric such as a spandex or lycra type of fabric strips or tape, although any suitable elastic banding material may also be used.

Figure 8:
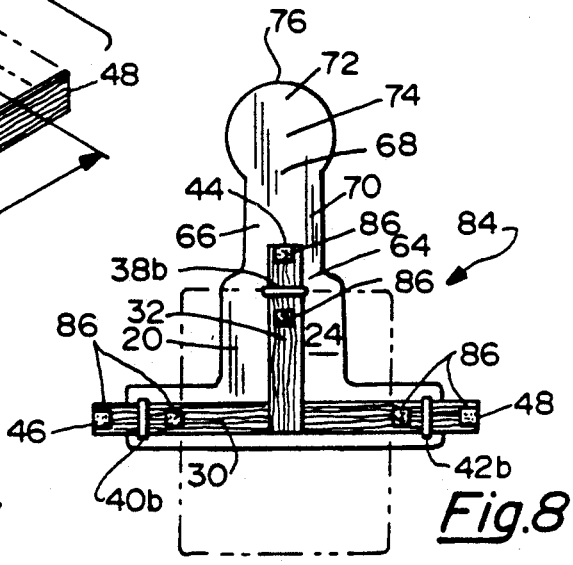
FIG. 8 is an elevated side view of an alternate embodiment of the new and improved credit card/money clip carrier of the present invention.

Referring now to FIG. 8, an alternate device 84 in accordance with this invention is shown. Alternate device 84 is similar to device 10 in most respects except that the credit card receiving area 26 is adapted to receive an insert card in a lengthwise orientation as indicated in phantom lines which is rotated 90° from the position shown in FIG. 1. The crimp sections 38*b*, 40*b* and 42*b* are all punched so that they project upwardly from the second major surface 24 of the planar support portion 20. In accordance with this alternate embodiment, the free ends 44, 46 and 48 of the elastic bands 30 and 32 are secured to the base portion 16 by being double back onto themselves to form a loop around the raised crimp strip and fastened by means of cooperating releasable fasteners 86, such as hook and loop or VELCRO® type fasteners or strips are rails around which the strap ends may be secured without crimping. The raised crimp strips in the embodiment shown in FIG. 8 serve as side guides and a depth guide for centering and positioning an inserted card with respect to the base member.

Referring now to FIGS. 9 and 10, still another embodiment for forming a credit card/money clip device accordance with the principles of the invention is shown in device 88. Device 88 is similar to device 10, except that instead of providing a credit card holding means and area using elastic straps the card gripping band means are provided by a pair of elongate prong fingers 90 and 92 struck from the planar support portion so that they lie in parallel spaced relation to the second major surface to define a card receiving slot and resilient prong means for holding one or more cards against the base member.

Referring now to FIGS. 11–12, still another embodiment of this invention is depicted by a credit card/money clip device 94, as shown. Device 94 is similar to device 88 except that instead of prong fingers 90 and 92, the credit card holding means comprises an elongate raised band or strip 96 extending parallel to the length dimension, a, of the planar support portion 20. Band or strip 96 defines an insertion slot for an inserted card as shown in FIG. 12.

In embodiments 88 and 94, the base portions, as shown in FIGS. 9–10 and 11–12 respectively, have a full rectangular planar support portion configuration, instead of the partially cut away T-formation shown in FIGS. 1–8.

Although the present invention has been described with reference to certain preferred embodiments, modifications or changes may be made therein by those skilled in this art. For example, although the clip means for forming the money clip side of the device has been illustrated with the integral U-shaped spring arm structure, other clips separate from the base member may be employed. By way of illustration, a spring loaded alligator clip structure may be mounted to the first major surface of the base member to define the money clip portion adapted to press the folded currency against the first major surface. Instead of forming the base member from metal, molded or die cast thermoplastics or rubbers or synthetic elastomers may be used. Illustrative moldable thermoplastics may include: polyolefins, such as polyethylene or polypropylene; polyesters such as polyethylene terephthalate (PET) or polybutylene, terephthalate (PBT) resins and blends may be used; as well as polyamides such as nylons; or polycarbonates or ABS or other synthetic or natural rubbers could be used to name but a few. These materials may be shaped to form the new and improved credit card/money clip devices of this invention in accordance with conventional methods known to those skilled in the art. Finally, instead of providing a planar support portion or base member having a generally rectangular peripheral configuration, a circular or oval or other configuration may also be selected. All such obvious modifications or changes may be made herein without departing from the scope and spirit of the present invention as defined in the appended claims.

I claim:

1. A credit card/money clip device comprising: a base member having first and second generally opposed major surfaces, clip means defined on one side of the base member for holding folded currency against the first major surface and resilient holding means on the opposed side of the base member and defining a credit card receiving area between the holding means and the second major surface for maintaining a card inserted into the card receiving area against the second major surface.

2. A credit card/money clip device as defined in claim 1, wherein the base member is configured so that folded currency and at least one credit-type card may be releasably retained on the base member generally within a common peripheral outline defined by the base member and the credit-type card combined.

3. A credit card/money clip device as defined in claim 1, wherein said holding means includes card positioning means for maintaining the card in a desired position with respect to the base member.

4. A credit card/money clip device as defined in claim 3, wherein said positioning means includes at least one stop abutment projecting from the base member and adapted to cooperatively engage an edge portion of a credit-type card inserted into said credit-card receiving area.

5. A credit card/money clip device as defined in claim 1, wherein said holding means includes at least one resilient band means extending in spaced relation to said second surface and positioned to resiliently bias a said at least one card inserted into the credit card receiving area against the second major surface of the base member.

6. A credit card/money clip device as defined in claim 5, wherein said band is stamped and formed from the base member.

7. A credit card/money clip device as defined in claim 5, wherein said band means comprises a T-strap of elastic strap material affixed to said base member.

8. A credit card/money clip device as defined in claim 5, wherein said clip means and base member comprise a unitary, one-piece member.

9. A credit card/money clip device as defined in claim 8, wherein the base member and clip means are stamped and formed from a sheet metal stock selected from brass, bronze, stainless steel, steel, chrome, pewter, tin, aluminum, silver and gold sheet metal stocks and gold or silver plated sheet metal stocks.

10. A credit card/money clip device as defined in claim 1, wherein said clip means is integral with the base member.

11. A credit card/money clip device as defined in claim 1, wherein the clip means is affixed to the base member.

12. A credit card/money clip device as defined in claim 1, wherein said clip means is adhesively bonded to said base member.

13. A credit card/money clip device as defined in claim 1, wherein said clip means is welded or soldered to said base member.

14. A credit card/money clip device as defined in claim 1, wherein said clip means and base member comprise a unitary, one-piece member.

15. A credit card/money clip device as defined in claim 14, wherein said clip means and base member comprises a molded rubber or a molded thermoplastic article.

16. A credit card/money clip device as defined in claim 1, wherein said clip means comprises a generally U-shaped spring member defined by a first leg and a second leg interconnected by a bight portion, said first leg having an end opposite the bight portion connected to and extending from the base member and a second leg having a free end opposite the bight portion biased toward and disposed in overlying relationship with the first surface, whereby folded currency inserted between the free end of the second leg and the first major surface is urged against the base member.

17. A credit card/money clip device comprising: a base member having first and second generally opposed major surfaces, clip means defined on one side of the base member for holding folded currency against the first major surface and resilient holding band means on the opposed side of the base member and defining a credit card receiving area between the holding means and the second major surface for maintaining a card inserted into the card receiving area against the second major surface, said band including a T-strap of elastic strap material affixed to said base member, sadi resilient band means extending in spaced relation to said second surface and positioned to resiliently bias a sadi at least one card inserted into the credit card receiving area against the second major surface of the base member.

* * * * *